United States Patent [19]

Auclair et al.

[11] Patent Number: 5,051,098

[45] Date of Patent: Sep. 24, 1991

[54] SERVICE CABLE GROUND CONNECTOR ASSEMBLY

[75] Inventors: William T. Auclair, Winsted; Randolph L. Auclair, New Hartford, both of Conn.

[73] Assignee: Electric Motion Company, Inc., Winsted, Conn.

[21] Appl. No.: 626,842

[22] Filed: Dec. 13, 1990

[51] Int. Cl.[5] ..... H01R 4/66

[52] U.S. Cl. ..... 439/99; 174/78; 439/98

[58] Field of Search ..... 174/78; 439/97-99

[56] References Cited

U.S. PATENT DOCUMENTS 2,930,835 3/1960 Bollmeier ..... 174/78

3,778,749 12/1973 Kapell ..... 174/78 X

FOREIGN PATENT DOCUMENTS 1574170 7/1969 France ..... 174/78

*Primary Examiner*—Eugene F. Desmond

*Attorney, Agent, or Firm*—Chilton, Alix & Van Kirk

[57] ABSTRACT

A ground connector assembly for a service cable employs a protective clip which is inserted between the inner sheath and the shield of a service cable. A machine screw is inserted between the clip and the shield to secure the clip in force-fit relationship. A terminal plate integrally extends from the clip and includes an aperture for connecting the assembly with a ground point.

20 Claims, 2 Drawing Sheets

SERVICE CABLE GROUND CONNECTOR ASSEMBLY

BACKGROUND OF THE INVENTION

This invention relates generally to deViCes and methods for grounding service cables. More particularly, this invention relates to devices and methods for grounding service cables which employ a shield.

Numerous devices have been advanced for connecting a ground wire to buried service cables which have a shield and a polymer lining. A key constraint in grounding such service cables is that the delicate shield of the cable not be damaged during installation of the ground connector assembly. It is also very desirable that the ground connection be implemented in an efficient manner in the field.

SUMMARY OF THE INVENTION

Briefly stated, the invention in a preferred form is a ground connector assembly for a service cable of a type which comprises at least one wire and an inner sheath, a shield and an outer sheath. A terminal/protector clip comprising a tapered portion is inserted between the shield and the inside sheath of the cable. An enlarged portion of the terminal/protector clip extends exteriorly from the cable and defines an aperture for mounting to a terminal post or connecting with the ground wire. A beveled paddle-shaped machine screw is positioned between the tapered portion of the terminal plate and the shield to secure the clip to the service cable in a force-fit relationship. A metal collar may be disposed at the end portion of the cable for circumferential engagement against the outer sheath.

In a second embodiment of the invention, a machine screw is inserted into the end portion of the service cable between a tapered protector clip and the shield. The protector clip is initially inserted between the shield and the inner sheath. A portion of the screw head is received in a slot of the clip. A flexible wire may be joined at the clip aperture. The wire extends exteriorly of the service cable and connects with a terminal clip. The terminal clip has an aperture for mounting to a terminal post or otherwise connecting with a ground connection.

An object of the invention is to provide a new and improved service cable assembly for connecting with a ground wire.

Another object of the invention is to provide a new and improved service cable ground connector assembly which is relatively easy to install in the field and provides a sound mechanical and electrical connection.

A further object of the invention is to provide a new and improved service cable ground connector assembly which may be installed for grounding buried service cables having a polymer lining without damaging the delicate shield.

Other objects and advantages of the invention will become apparent from the drawings and the specification.

DETAILED DESCRIPTION OF THE PREFERRED EMBODIMENT

Figure 1:
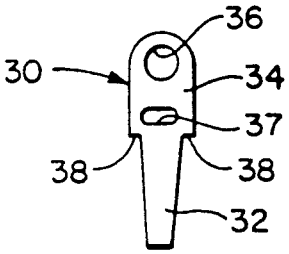
FIG. 1 is front elevational view of a terminal/protector clip for a service cable ground connector assembly in accordance with the present invention.
Figure 2:
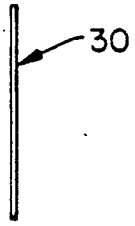
FIG. 2 is a side view of the terminal/protector clip of FIG. 1.
Figure 3:
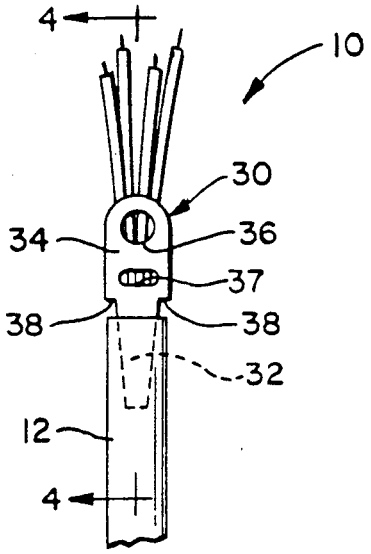
FIG. 3 is a front elevational view of the terminal/protector clip of FIG. 1 installed to an end portion of a service cable.

With reference to the drawings wherein like numerals represent like parts throughout the several figures, a service cable ground connector assembly in accordance with the present invention is generally designated by the numeral 10. The ground connector assembly 10 mounts at a terminus of a service cable to provide a connector for implementing a ground connection with a terminal post of a ground terminal or connecting with a grounding point by various means.

The ground connector assembly 10 is particularly suitable for installation in conjunction with a buried service cable 12. Service cable 12 has a conventional form which includes a plurality of longitudinally extending service wires 14 having a polyethylene coating and enclosed in a continuous polymer inner sheath 16 which may be manufactured from polyethylene, a rubber composite or other similar materials. A smooth metallic shield 18 of aluminum having a Mylar lining fused to the shield surrounds the inner sheath 16. A relatively thick outer sheath 20 of polyethylene material surrounds the metal shield. In some embodiments the inner sheath is not employed.

The ground connector assembly 10 is installed by removing approximately a $\frac{1}{8}$ inch portion of the outer sheath 20 at a terminal end portion of the service cable. A longitudinal slit 21 of approximately one inch is cut into the outer sheath 20 at the terminal end portion. The trailing ends of wires 14 are typically approximately 3 to 5 inches in length. A metal terminal/protector clip 30 comprises a tapered protective blade portion 32 and an integral enlarged terminal portion 34. The terminal portion 34 has an aperture 36 which may be employed to either mount the terminal portion to a terminal post of a ground terminal or connect the terminal portion with a ground wire or ground point. In addition, a slot 37 is located in the terminal portion between aperture 36 and tapered portion 32.

The clip 30 may be a thin planar member having a uniform thickness formed from copper or brass with a tin plating. The protective blade portion 32 is dimensioned so that it may be inserted between the inner sheath 16 and the shield 18 of the buried service wire. The protective blade portion is inserted diametrally opposite slit 21 until shoulders 38 extending transversely from the proximal blade portion at the underside of the terminal portion engage the adjacent end of the outer sheath 20. The shoulders 38 are dimensioned to transversely project a sufficient distance so that they function as a stop upon engagement against the exposed end portions of the cable.

Figure 4:
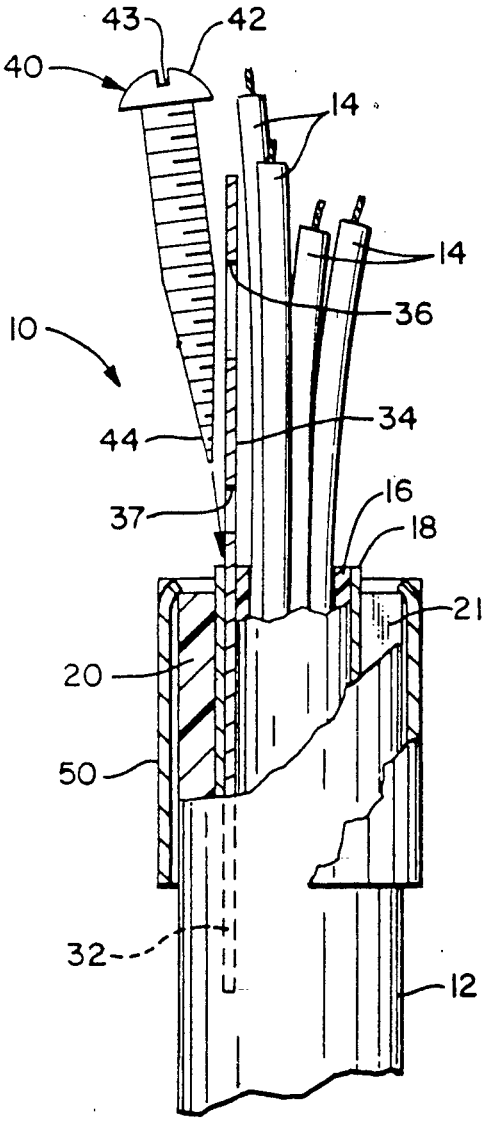
FIG. 4 is an enlarged sectional view, partly broken away, of the service cable ground connector assembly taken along the line 4—4 of FIG. 3 and further illustrating an installation step and additional assembly components.
Figure 5:
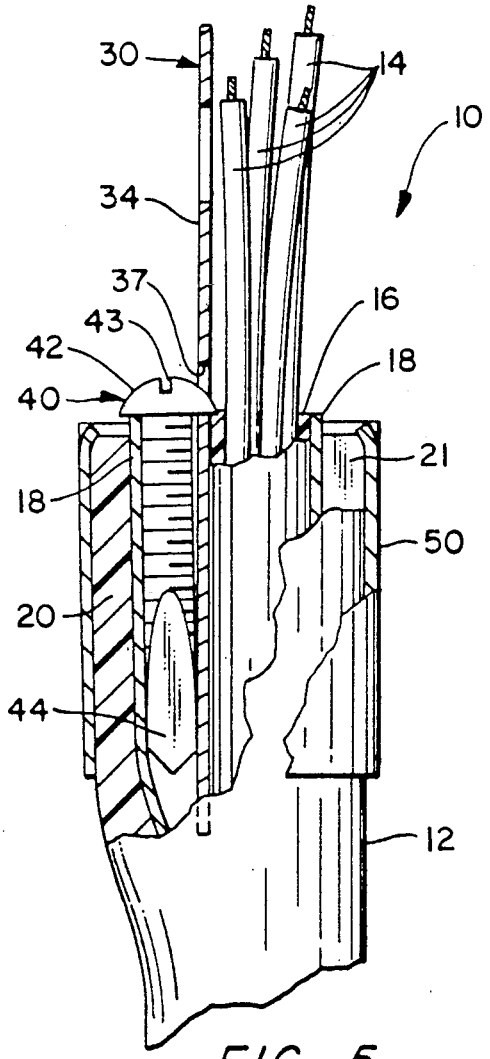
FIG. 5 is an enlarged side sectional view, partly broken away, of the installed service cable ground connector assembly of FIG. 4.

A machine screw 40 includes a head 42 having a screwdriver blade slot 43 and a beveled paddle-tip distal end portion 44 (FIGS. 4 and 5). The machine screw is inserted between the inserted terminal/protector clip 30 and the shield 18. The screw is torqued by a flat blade screwdriver and driven longitudinally into the cable until the head 42 is transversely slipped into or seated in slot 37 and the flattened beveled faces of the screw are angularly oriented as illustrated in FIG. 5. The screw 40 and in particular end portion 44 bears against the protective blade portion 32 and the shield 18 to provide a tight force-fit engagement of the terminal/protector clip 30 with the service cable. The interengagement of the screw head 42 and the slot 37 results in a relatively high mechanical resistance to axial pull-out of the screw and the clip. Preferred embodiments of screw 40 are No. 6×32 or No. 4×40 machine screws which have been bevelled at the distal end portion of the threaded shank.

The terminal portion 34 extends exteriorly from the end of the service cable (axially as illustrated in the drawings). The terminal portion 34 may then be connected to a ground plate such as a terminal post, a ground wire connection or other suitable ground point.

The ground connector assembly 10 comprising the clip 30 and the machine screw 40 at the end of the service cable provides an effective and efficient means for installing a ground connector. Installation of the ground connector assembly does not result in damage to the delicate shield 18. Moreover, the ground connector may be installed with a flat blade screwdriver and without any special tools. The ground connector assembly 10 has particular applicability in connection with buried service cables which have a polymer lining. During installation the machine screw 40 and clip 30 will remove a portion of the polymer lining but not damage the shield.

As illustrated in FIGS. 4 and 5, a metal collar 50 may be inserted over the end of the service cable prior to insertion of the machine screw 40 and protector clip 30 The collar 50 has a pair of opposing indentations 52 and 54 at the terminal end. The indentations 52 and 54 engage terminal edges of the outer sheath to prevent the collar from slipping down the cable. Alternately one or more The collar 50 functions to tabs may be employed in place of indentations, prevent breakage and splaying of the end portions of the service cable and also imparts a smooth contoured finish to the end of the cable. The collar preferably extends circumferentially to engage the outer sheath 20 in a tight force-fit engagement.

Figure 6:
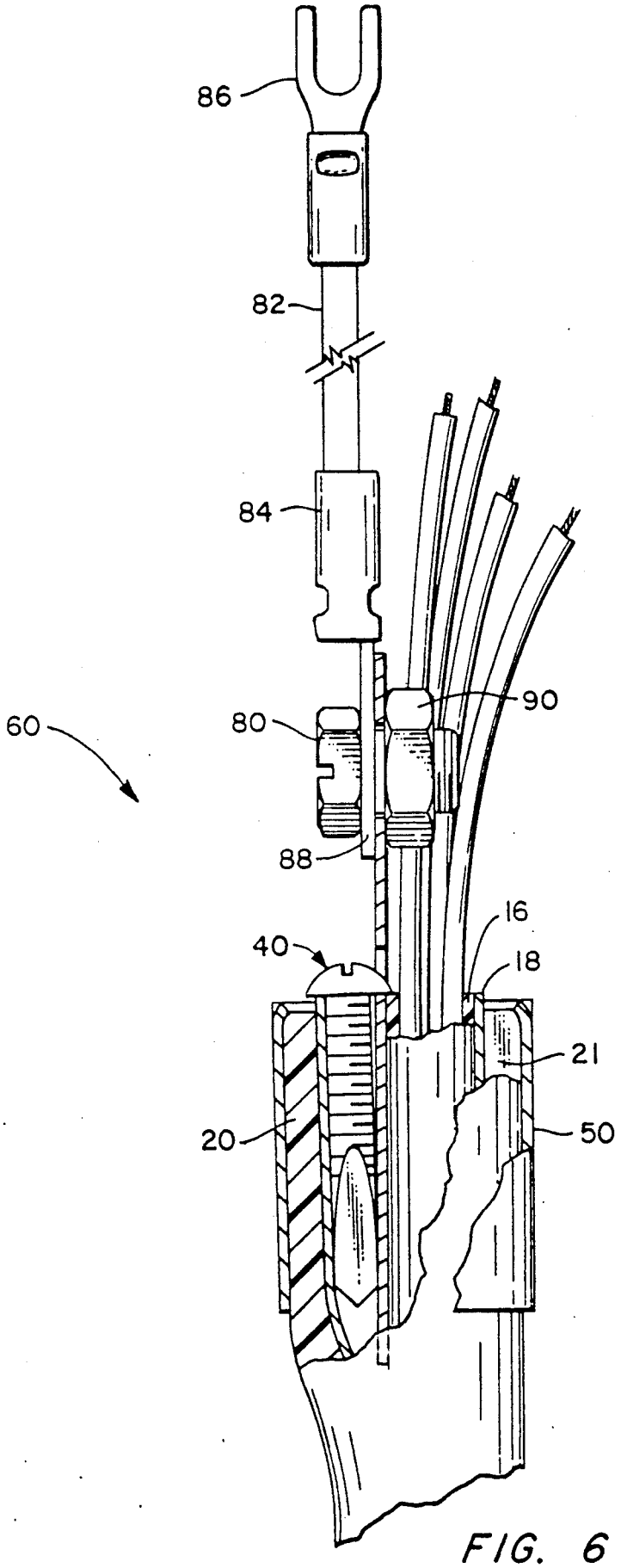
FIG. 6 is an enlarged side sectional view, partly broken away and partly in perspective, of a second embodiment of a service cable ground connector assembly in accordance with the present invention.

With reference to FIG. 6, a second embodiment of a service cable ground connector assembly in accordance with the present invention is generally designated by the numeral 60. A flexible wire 82 has a pair of terminal clips 84 and 86 crimped at opposing ends. The terminal clip 84 may form a central aperture 88. Clip 86 is dimensioned so that the clip may be mounted to the terminal post of the ground terminal. Alternately, the clip 86 may be connected with a ground wire or ground point by other conventional means. A screw 80 inserted through apertures 36 and 88 and secured by nut 90 connects the wire 82 with a ground terminal. The wire 82 may typically be a No. 10, 12 or 14 AWG solid wire.

It will be appreciated that ground connector assembly 60 may also be installed in an effective and efficient manner which does not require special tools and does not damage the delicate shield of the service cable. Ground connector assembly 60 provides more flexibility in implementing a ground connection because there is greater latitude for locating and orienting the terminal clip 86 vis-a-vis the end of the service cable.

While a preferred embodiment of the foregoing invention has been set forth for purposes of illustration, the foregoing description should not be deemed a limitation of the invention herein. Accordingly, various modifications, adaptations, and alternatives may occur to one skilled in the art without departing from the spirit and the scope of the present invention.

What is claimed is:

1. A ground connector assembly for a service cable comprising:

an end portion of a service cable comprising at least one longitudinally extending wire, a shield surrounding said at least one wire and an outer sheath surrounding said shield;

clip means comprising a protective blade portion and an integral terminal portion defining an aperture, said protective blade portion being positioned between a said wire and said shield, and said terminal portion being located exteriorly of said cable end portion; and a screw disposed between said protective blade portion and said shield so that said clip means is secured to said service cable in force-fit relationship.

2. The ground connector assembly of claim 1 wherein said screw comprises a machine screw having a head and a beveled paddle-shaped distal tip.

3. The ground connector assembly of claim 2 wherein said clip means further defines a slot and a portion of said screw head is received in said slot.

4. The ground connector assembly of claim 1 wherein said clip means further comprises a transition shoulder, said transition shoulder engaging end portions of said service cable.

5. The ground connector assembly of claim 1 further comprising a collar engagable against said outer sheath and enclosing portions of said screw and clip means.

6. The ground connector of claim 5 further comprising at least one integral indentation at one end of said collar.

7. The ground connector assembly of claim 1 wherein said clip means is a generally planar member and said protective blade portion is tapered and generally co-planar with said terminal portion.

8. The ground connector assembly of claim 7 wherein said clip means further comprises means defining a slot disposed between said aperture and protective blade portion.

9. A ground connector assembly for a service cable comprising:

an end portion of a service cable comprising at least one longitudinally extending wire, an inner sheath surrounding said at least one wire, a shield surrounding said inner sheath, and an outer sheath surrounding said shield;

a protective clip disposed between said shield and inner sheath, said clip comprising a terminal portion projecting from said shield and inner sheath;

a fastener disposed between said protective clip and said shield and secured to said service cable in force-fit relationship; and electrical conductor means connected to said terminal portion and extending exteriorly from said service cable.

10. The ground connector assembly of claim 9 wherein said terminal portion defines an aperture and said conductor means is secured to said terminal portion through said aperture.

11. The ground connector assembly of claim 9 wherein said protective clip defines a tapered blade-like portion having a pair of opposing shoulders which engage end portions of said service cable.

12. The ground connector assembly of claim 9 wherein said electrical conductor means comprises a wire and a terminal clip connected at each end of the wire.

13. The ground connector assembly of claim 9 further comprising a metallic collar surrounding said outer sheath and engageable therewith.

14. The ground connector assembly of claim 13 wherein said collar has a pair of diametrically opposed indentations at one end of said collar.

15. The ground connector assembly of claim 9 wherein said clip defines a slot and said fastener has a head, a portion of said head being received in said slot.

16. The ground connector assembly of claim 9 wherein said fastener is a machine screw having a beveled distal end portion.

17. The ground connector assembly of claim 10 wherein said conductor means comprises a terminal clip defining an aperture and a fastener is secured through said terminal clip and terminal portion apertures to connect said conductor means to said terminal portion.

18. A ground connector assembly for a service cable comprising:

an end portion of a service cable comprising at least one longitudinally extending wire, a shield surrounding said at least one wire, and an outer sheath surrounding said shield;

clip means comprising a protective blade portion and an integral terminal portion defining an aperture, said protective blade portion being positioned between a wire and said shield, and said terminal portion being located exteriorly of said cable end portion, said clip means defining a slot and shoulder means projecting generally transversely and engageable against end portions of said service cable; and a fastener having a head and a bevelled distal tip portion disposed between said protective blade portion and said shield so that said clip means is secured to said service cable in force-fit relationship and a portion of said head is disposed in said slot.

19. The ground connector of claim 18 wherein said outer sheath defines a longitudinal slit and said clip means is positioned generally diametrically opposite said slit.

20. The ground connector assembly of claim 19 further comprising a collar engageable against said outer sheath and enclosing portions of said fastener and clip means, said collar and having indentation means for interiorly engaging end portions of said outer sheath.

* * * * *